US010249229B2

(12) United States Patent
Shin et al.

(10) Patent No.: US 10,249,229 B2
(45) Date of Patent: Apr. 2, 2019

(54) POWER SWITCHING CIRCUIT AND METHOD FOR CONTROLLING SAME

(71) Applicant: Silicon Works Co., Ltd., Daejeon (KR)

(72) Inventors: Yoon Soo Shin, Seoul (KR); Ji Woong Han, Gyeonggi-Do (KR); Dea Hwan Lee, Sejong (KR)

(73) Assignee: Silicon Works Co., Ltd., Daejeon (KR)

( * ) Notice: Subject to any disclaimer, the term of this patent is extended or adjusted under 35 U.S.C. 154(b) by 14 days.

(21) Appl. No.: 15/152,978

(22) Filed: May 12, 2016

(65) Prior Publication Data

US 2016/0335988 A1 Nov. 17, 2016

(30) Foreign Application Priority Data

May 14, 2015 (KR) ..... 10-2015-0067371

(51) Int. Cl.
*G09G 5/10* (2006.01)
*G09G 3/20* (2006.01)

(52) U.S. Cl.
CPC ..... *G09G 3/2022* (2013.01); *G09G 3/2014* (2013.01); *G09G 2310/0218* (2013.01); *G09G 2310/08* (2013.01); *G09G 2320/0233* (2013.01)

(58) Field of Classification Search
USPC ..... 323/234, 282
See application file for complete search history.

(56) References Cited

U.S. PATENT DOCUMENTS 5,627,460 A 5/1997 Bazinet et al.
8,339,390 B2 12/2012 Takada et al.
8,604,705 B2 12/2013 Ko et al.
8,791,647 B2 7/2014 Kesterson et al.
8,941,575 B2 1/2015 Shen et al.
9,182,805 B2 11/2015 Kim et al.
9,224,340 B2 12/2015 Jin
2005/0206358 A1* 9/2005 Van Der Horn ..... H02M 3/156 323/282

(Continued)

FOREIGN PATENT DOCUMENTS

EP 2194636 B1 6/2010
JP 5453038 B2 3/2014

(Continued)

*Primary Examiner* — Jennifer Mehmood
*Assistant Examiner* — Deeprose Subedi
(74) *Attorney, Agent, or Firm* — Mintz Levin Cohn Ferris Glovsky and Popeo, P.C.; Kongsik Kim; Jhongwoo Jay Peck

(57) ABSTRACT

A power switching circuit and a method for controlling the same are disclosed herein. The power switching circuit includes a frequency control circuit, a pulse modulation circuit, and a switching convertor. The frequency control circuit receives a first reference signal driving a load, from a timing controller, and generates a second reference signal based on the first reference signal. The pulse modulation circuit generates a pulse control signal by performing pulse width modulation (PWM) or pulse frequency modulation (PFM) on the second reference signal. The switching convertor generates the voltage of output power by switching a switching element connected to the output power, in response to the pulse control signal. The pulse control signal is synchronized with the first reference signal driving the load.

12 Claims, 8 Drawing Sheets

(56) References Cited

U.S. PATENT DOCUMENTS

| | | | | |
|---|---|---|---|---|
| 2009/0218994 | A1* | 9/2009 | Liu | H02M 3/337<br>323/234 |
| 2013/0307510 | A1* | 11/2013 | Chuang | H02M 3/1588<br>323/284 |
| 2014/0009510 | A1 | 1/2014 | Jin | |
| 2016/0035320 | A1 | 2/2016 | Yoon et al. | |

FOREIGN PATENT DOCUMENTS

| | | | |
|---|---|---|---|
| KR | 10-0635950 | B1 | 10/2006 |
| KR | 10-1077372 | B1 | 10/2011 |
| KR | 10-2013-0092924 | A | 8/2013 |
| KR | 10-1467685 | B1 | 12/2014 |
| KR | 10-1471388 | B1 | 12/2014 |
| KR | 10-2015-0002195 | A | 1/2015 |
| KR | 10-1502686 | B1 | 3/2015 |
| KR | 10-1508418 | B1 | 4/2015 |

* cited by examiner

POWER SWITCHING CIRCUIT AND METHOD FOR CONTROLLING SAME

CROSS-REFERENCE TO RELATED APPLICATION

This application claims under 35 U.S.C. § 119(a) the benefit of Korean Application No. 10-2015-0067371 filed on May 14, 2015, which is incorporated herein by reference.

TECHNICAL FIELD

The present invention relates generally to technology for maintaining an output voltage, to be provided to a load, at a constant level using a switching converter circuit, and more particularly to a switching converter circuit that is capable of maintaining the brightness of an overall screen at a uniform level when an array of pixels on a display screen is driven, and technology for controlling the same.

BACKGROUND ART

Thin-Film Transistor Liquid Crystal Displays (TFT-LCDs), Organic Light Emitting Displays (OLEDs), etc. are being currently widely used as display devices for TVs, computers or mobile phones. In such a display device, the array of pixels of a TFT-LCD or an OLED scans data in response to signals that are sequentially applied, and then semiconductor devices, constituting the pixels of a first scanned line, start to emit light in response to light emission signals that are sequentially applied.

Meanwhile, a regulator or switching converter for maintaining power, driving a display device, at a constant value generates an operating frequency using its own oscillator, and thus the power follows the frequency of the internal oscillator.

An example of the conventional technology is disclosed in Korean Patent No. 10-0635950 entitled "OLED Data Drive Circuit and Display System." FIG. 1 schematically shows the configuration of a conventional power switching circuit 10.

Referring to FIG. 1, the conventional power switching circuit 10 includes an oscillator 11, a pulse width/frequency modulation controller 12, a switching converter 13, and a feedback circuit 14. The pulse width/frequency modulation controller 12 receives a second reference signal 11 generated by the oscillator 11, and generates a pulse control signal 12*a*. The switching converter 13 may provide the voltage V_EL of output power to a load 30 in response to the pulse control signal 12*a*. In this case, the feedback circuit 14 may be further included. The feedback circuit 14 may generate feedback information so that the voltage V_EL of the output power generated by the switching converter 13 can be maintained within a reference error range from a target voltage, and may transfer the feedback information to the pulse width/frequency modulation controller 12.

The load 30 may be the array of pixels of an OLED or a TFT-LCD. An operation in which the pixels of the load 30 scan data and an operation in which the pixels emit light may be all performed by a first reference signal 20*a* that is provided by a timing controller 20 installed outside the power switching circuit 10.

In the conventional technology, the first reference signal 20*a* adapted to sequentially drive the pixels has a first frequency f1 and the second reference signal 11*a* adapted to drive the power switching circuit 10 has a second frequency f2, and thus there may be a slight difference between the timing of the operation of sequentially driving the pixels and the timing of the operation of driving the power switching circuit 10.

FIG. 2 is a diagram showing an example of the operating waveform of the output voltage V_EL of the power switching circuit 10 of FIG. 1.

Referring to FIG. 2, there are shown a time frame 40 indicative of a period during which all pixels constituting the load 30 scan data and emit light, a first time interval 41 indicative of a period during which some region of the pixels scans data and emits light once, and a second time interval 42 indicative of a period during which another region of the pixels scans data and emits light once.

Since the power switching circuit 10 is internally driven by the pulse control signal generated by the oscillator 11, it performs a cycle of switching operation during each period 43 of the pulse control signal.

In this case, the first time interval 41 is not synchronized with the period 43 of the pulse control signal, and thus the cycle of the switching operation of the power switching circuit 10 is not completed during the first time interval 41. In this case, as shown in FIG. 2, an effective output voltage V_EL with which the load 30 is supplied during the first time interval 41 may be represented by the first average value 41*a*.

The second time interval 42 is not also completely synchronized with the period 43 of the pulse control signal, and thus the cycle of the switching operation of the power switching circuit 10 is not completed during the second time interval 42. An effective output voltage V_EL with which the load 30 is supplied with the second time interval 42 may be represented by the second average value 42*a*.

As described above, since the effective output voltage V_EL transferred to the load 30 during the first time interval 41 and the effective output voltage V_EL transferred to the load 30 during the second time interval 42 are the first average value 41*a* and the second average value 42*a*, i.e., different values, a problem arises in that the brightness of pixels that emit light during the first time interval 41 and the brightness of pixels that emit light during the second time interval 42 are different from each other.

Furthermore, there is concern that the pixels that emit light during the first time interval 41 may receive an average value, different from the first average value 41*a*, as the effective output voltage V_EL in a subsequent time interval (not shown) in which the pixels are sequentially operated, and thus there is concern that the brightness of the same pixel is not uniform over time and varies irregularly.

In summary, in the conventional technology of FIGS. 1 and 2, the brightness values of pixels at different locations may not be uniform, and the current and subsequent period brightness values of even the same pixel may not be uniform.

Therefore, there is a demand for technology for implementing a power switching circuit that can overcome the above-described problems.

SUMMARY OF THE DISCLOSURE

Accordingly, the present invention has been made keeping in mind the above problems occurring in the prior art, and an object of the present invention is to provide a power switching circuit that is capable of maintaining the brightness of pixels, constituting the screen of a display device, at a uniform level regardless of the locations thereof.

An object of the present invention is to provide a power switching circuit that is capable of maintaining the brightness of pixels, constituting the screen of a display device, at a uniform level regardless of changes in time.

An object of the present invention is to synchronize the period or average period of a pulse control signal adapted to drive a power switching circuit with a periodic timing signal T-CON adapted to drive a load, thereby supplying a uniform effective power voltage to the sectional regions of the load.

An object of the present invention is to divide pixels, constituting the screen of a display device, into rows, columns, blocks, or sub-regions and then provide a uniform power voltage to the pixels of different rows, columns, blocks, or sub-regions, thereby maintaining uniform brightness.

An object of the present invention is to be used to maintain the uniform brightness of the channels of a multichannel LED, as well as to maintain the uniform brightness of pixels constituting the screen of a display device.

According to an aspect of the present invention, there is provided a power switching circuit, including: a frequency control circuit configured to receive a first reference signal, adapted to drive a load, from a timing controller and generate a second reference signal based on the first reference signal; a pulse modulation circuit configured to generate a pulse control signal by performing pulse width modulation (PWM) or pulse frequency modulation (PFM) on the second reference signal; and a switching convertor configured to generate the voltage of output power by switching a switching element, connected to the output power, in response to the pulse control signal.

The pulse control signal may be synchronized with the first reference signal adapted to drive the load.

The pulse modulation circuit may perform operation in the state in which the start and end points of a pulse control signal group, including a series of pulse control signals, have been synchronized with the start and end points of the first reference signal in consideration of the characteristic in which PFM has different pulse periods unlike PWM.

A first region, including a part of the pixels on the screen, may be displayed during the first time interval, and a second region, including another part of the pixels on the screen, may be displayed during the second time interval. That is, the range in which the load is driven to emit light may be set to a row, a column, a block or a sub-region, and a uniform power voltage may be provided to the range, thereby maintaining uniform brightness.

The apparatus may further include a feedback circuit configured to generate a feedback signal in response to the voltage of the output power and transfer the feedback signal to the pulse modulation circuit.

The pulse modulation circuit may generate a pulse modulation signal so that the average voltage of the output power in each of the first and second time intervals is maintained within a reference error range from a target voltage.

According to another aspect of the present invention, there is provided a method for controlling a power switching circuit, including: receiving a first reference signal, adapted to drive a load, from a timing controller; generating a second reference signal based on the first reference signal; generating a pulse control signal by performing PWM or PFM on the second reference signal; and generating an output power level by switching between input power and output power in response to the pulse control signal.

The method may further include generating a feedback signal in response to the voltage of the output power and transferring the feedback signal to the pulse modulation circuit.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE DISCLOSURE

The terms used herein will be used merely to describe embodiments, and are not intended to limit the present invention. A singular form may include a plural form unless otherwise defined. The terms, including "comprise," "includes," "comprising," "including" and their derivatives, specify the presence of described features, numbers, steps, operations, components, parts and/or combinations thereof, and do not exclude the possibility of the presence or addition of one or more other features, numbers, steps, operations, components, parts, and/ or combinations thereof.

Unless otherwise defined herein, all terms, including technical or scientific terms used herein, have the same meanings as commonly understood by those skilled in the art to which the present invention pertains. Terms, such as those defined in commonly used dictionaries, should be interpreted as having meanings that are consistent with their meanings in the context of the specification and relevant art, and should not be interpreted in an idealized or overly formal sense unless expressly so defined herein.

Embodiments of the present invention will be described in detail below with reference to the accompanying drawings. In the following description, detailed descriptions of well-known components or functions that may unnecessarily make the gist of the present invention obscure will be omitted.

However, the present invention is not limited or restricted by these embodiments. Throughout the accompanying drawings, the same reference symbols are used to designate the same components.

Figure 3:
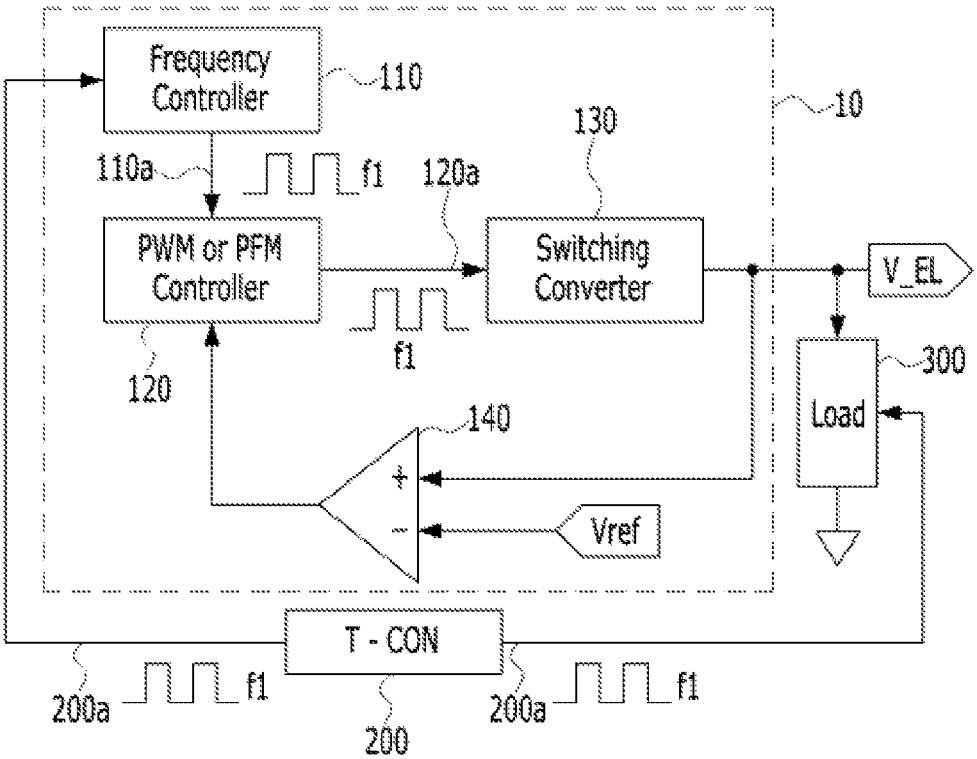
FIG. 3 is a block diagram showing a power switching circuit according to an embodiment of the present invention.

FIG. 3 is a block diagram showing a power switching circuit 100 according to an embodiment of the present invention.

Referring to FIG. 3, the power switching circuit 100 according to the present embodiment includes a frequency control circuit 110, a pulse modulation circuit 120, and a switching converter 130.

The frequency control circuit 110 receives a first reference signal 200*a*, adapted to drive a load 300, from a timing controller 200, and generates a second reference signal 110*a* based on the first reference signal 200*a*. The frequency control circuit 110 receives the first reference signal 200*a*, and generates the divided/buffered second reference signal 110*a* in order to drive the switching converter 130.

The pulse modulation circuit 120 generates a pulse control signal 120*a* by performing pulse width modulation (PWM) or pulse frequency modulation (PFM) on the second reference signal 110*a*. Since the pulse control signal 120*a* is also based on the first reference signal 200*a* having a first frequency f1, it has a phase synchronized with that of the first reference signal 200*a*.

The frequency control circuit 110 may divide the frequency of the first reference signal 200*a*, and may buffer the first reference signal 200*a* without change. In this case, when the frequency of the second reference signal 110*a* is higher than that of the first reference signal 200*a*, each of a series of pulses constituting the second reference signal 110*a* is not synchronized with that of the first reference signal 200*a*, with the result that a group of a series of pulses constituting the second reference signal 110*a* may be synchronized with that of the first reference signal 200*a*. For example, assuming that the first reference signal 200*a* has a frequency of 1 MHz and the second reference signal 110*a* has a frequency of 8 MHz, the start point of a pulse group, including the eight pulses of the second reference signal 110*a*, may be synchronized with that of the pulses of the first reference signal 200*a*.

The concept of such synchronization between a pulse group and the first reference signal 200*a* may also be applied to a case when the pulse modulation circuit 120 adopts any one of PWM and PFM methods. In the case of PWM, the period of the pulse control signal 120*a* is constant, and thus particular measurements do not need to be taken when the pulse or pulse group of the second reference signal 110*a* is synchronized with the pulse of the first reference signal 200*a*. In contrast, in the case of PFM, the period of the pulse control signal 120*a* may vary, and thus an additional synchronization reference is required. For example, when the pulse modulation circuit 120 controls the frequency of each pulse of the pulse control signal 120*a* by applying a PFM technique, it may control the frequencies of N pulses so that the average frequency thereof is constant. N may be an arbitrary number, and may be, for example, 16, 32, 64 or the like. When N is 64, a pulse group, including the 64 pulses of the pulse control signal 120*a*, has a constant frequency. The frequency control circuit 110 may determine the size of the pulse group of the second reference signal 110*a*, to be synchronized with the first reference signal 200*a*, by taking into account the pulse modulation technique of the pulse modulation circuit 120.

Figure 1:
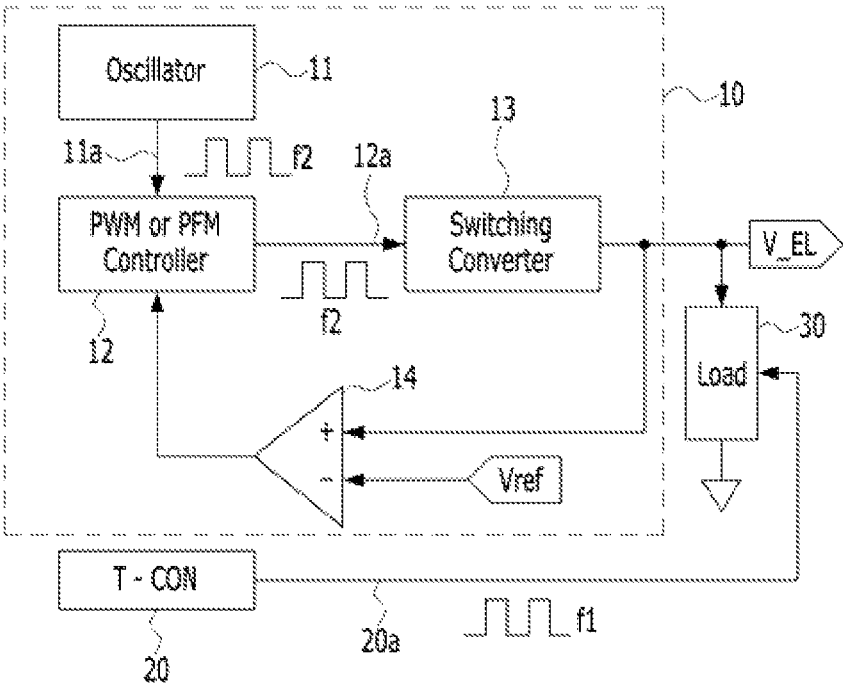
FIG. 1 (PRIOR ART)
FIG. 1 is a block diagram showing a conventional power switching circuit.
Figure 2:
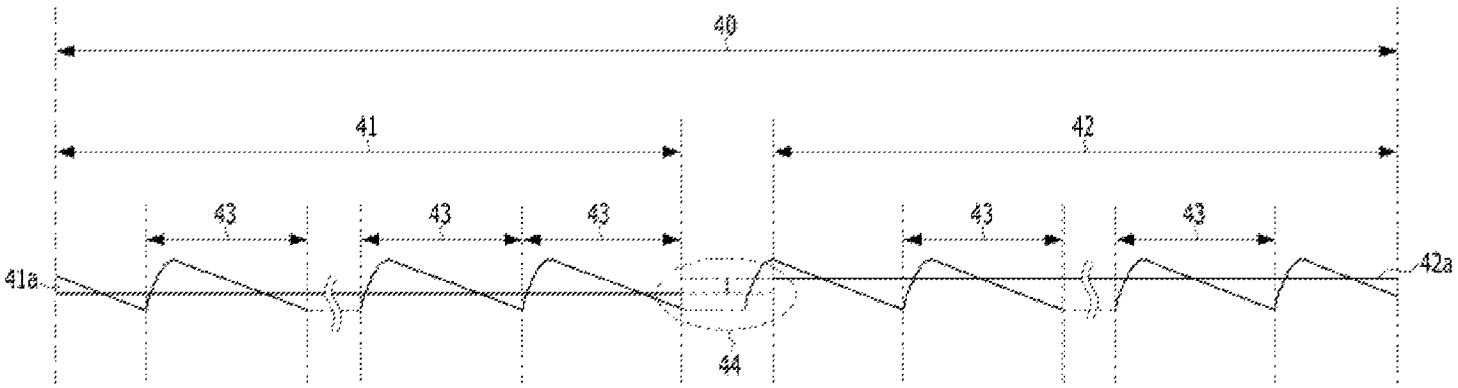
FIG. 2 (PRIOR ART)
FIG. 2 is a diagram showing an example of the operating waveform of the output voltage of the power switching circuit of FIG. 1.

Meanwhile, the switching converter 130 generates the voltage V_EL of output power by switching a switching element (not shown), connected to the output power, in response to the pulse control signal 120*a*. In this case, the switching converter 130 may be a buck converter or a boost converter depending on the topology of circuit configuration. In any case, the switching converter 130 drives output power from a separate power source via a switching element. For a well-known example of the switching converter 130, FIG. 1 of U.S. Pat. No. 5,627,460 entitled "DC/DC Converter having a Bootstrapped High Side Driver" may be referred to. This preceding document may be cited as a reference to implement an embodiment of the present invention, but the technical spirit of the present invention is not limited to the preceding document. The configuration of the switching element connected to the output power will be apparent to those skilled in the art from the description of the present specification. In this case, the power switching circuit 100 may further include a feedback circuit 140 in order to stabilize the voltage V_EL of the output power that is provided to the load 300.

The feedback circuit 140 generates a feedback signal in response to the voltage V_EL of the output power, and transfers the feedback signal to the pulse modulation circuit 120.

The feedback circuit 140 may compare the voltage V_EL of the output power output from the switching element with a reference voltage Vref, and may transfer a feedback signal, into which the results of the comparison have been incorporated, to the pulse modulation circuit 120. The pulse modulation circuit 120 generates the pulse control signal 120*a* in response to the feedback signal and the second reference signal 110*a*. In this case, it will be apparent to those skilled in the art that the feedback signal may be a reference based on which the duty cycle of the pulse control signal 120*a* is controlled.

Figure 4:
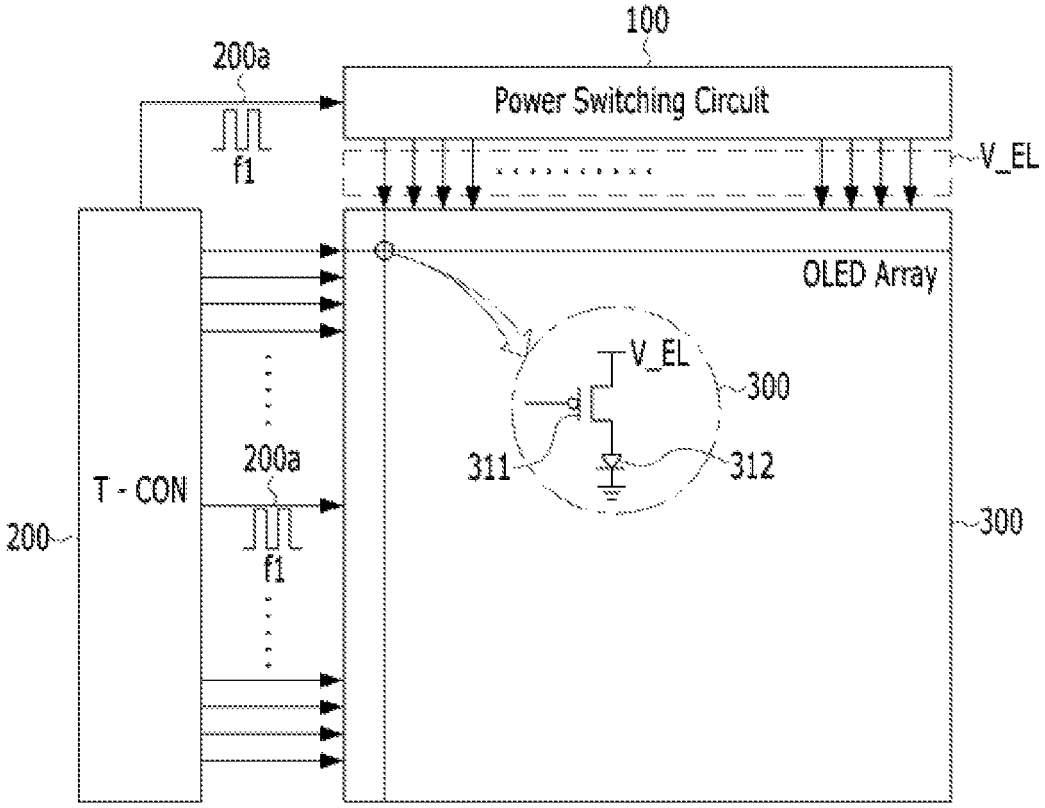
FIG. 4 is a block diagram conceptually showing a power switching circuit having an OLED array as a load according to an embodiment of the present invention.

In this case, based on the feedback information, the pulse modulation circuit 120 may generate the pulse modulation signal 120*a* so that the average voltage of output power in each of first and second time intervals can be maintained within a reference error range from a target voltage, and may provide the uniform voltage V_EL of the output power to the load 300. FIG. 4 is a block diagram conceptually showing a power switching circuit having an OLED array as a load according to an embodiment of the present invention. Although the technical spirit of the present invention may be widely applied to circuits for driving an OLED, a TFT-LCD, a multichannel LED and the like, the present invention will be described with a focus on the OLED array, i.e., the load 300 of FIG. 4, herein for ease of description. Referring to FIG. 4, the timing controller 200 provides the first reference signal 200*a* having a first frequency f1 to both the power switching circuit 100 and the load 300. The power switching circuit 100 may provide the voltage V_EL of the output power to the load 300 through a switching operation synchronized with the first reference signal 200*a* of the timing controller 200 configured to drive the load 300.

Each of the pixels 310 constituting the load 300 may be implemented to include a pass transistor 311 configured to transfer the voltage V_EL of the output power of power switching circuit 100 to an OLED 312. In this case, the pass transistor 311 is driven by a control signal derived from the first reference signal 200*a*. Since the voltage V_EL of the output power of the power switching circuit 100 functions as supply power adapted to drive the pass transistor 311 and the OLED 312, to transfer uniform supply power to each of the pixels 310 constituting the load 300 is a significantly important purpose required to maintain the brightness of an overall display screen at a uniform level.

Figure 5:
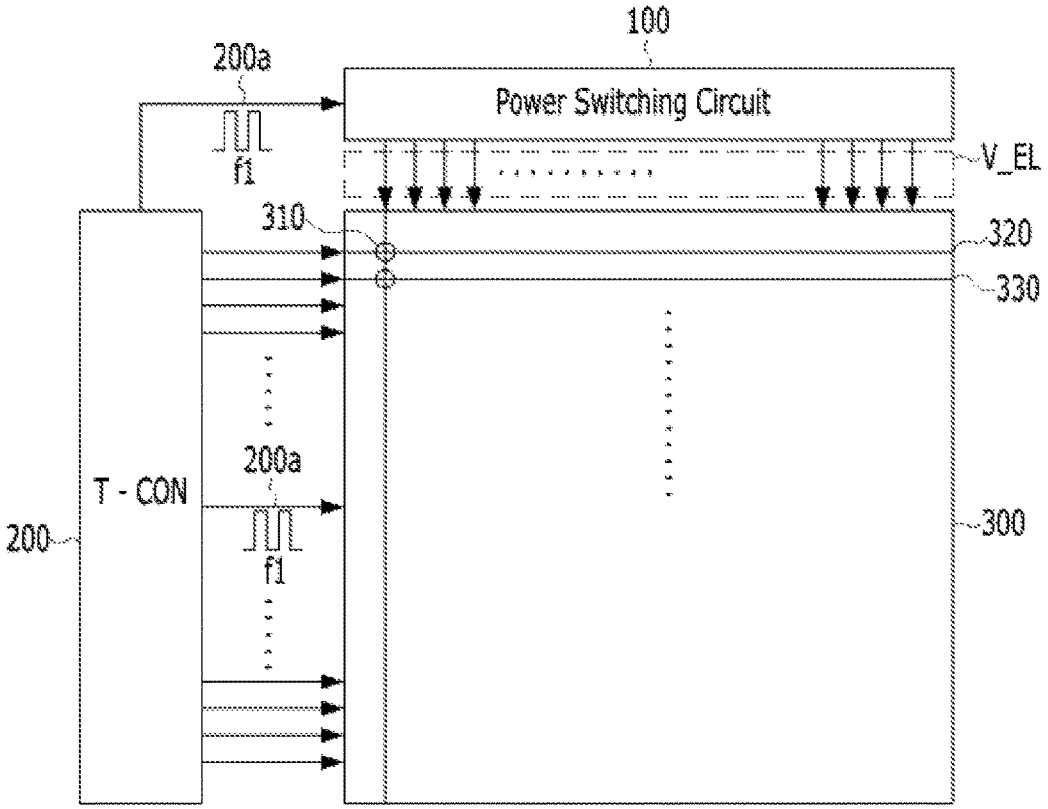
FIG. 5 is a block diagram showing the embodiment of FIG. 4 from another point of view.

FIG. 5 is a block diagram showing the embodiment of FIG. 4 from another point of view.

Referring to FIG. 5, the pixels 310 of the load 300 form rows and columns, and are arranged in the form of an array. Each of a first row 320 and a second row 330 shown in FIG. 5 includes a plurality of pixels 310.

When the load 300 is a set of pixels 310 constituting a single display screen, the single display screen operates at a predetermined frequency. For example, the overall display screen may operate at a frequency of 60 Hz like a general LCD display or OLED display. In this case, the pixels 310 constituting the display screen are divided into N rows, the first reference signal 200*a* may operate at a frequency N or larger times 60 Hz.

For the overall display screen to be scanned at a frequency of 60 Hz, all the pixels 310 of the display screen need to be refreshed within a time interval of 16.66 msec. For ease of description, when 16.66 msec is defined as a first time frame, each of N rows is refreshed during a time interval corresponding to 1/N of the first time frame. That is, the first row 320 may be driven during the first time interval corresponding to 1/N of the first time frame, and the second row 330 may be sequentially driven during a second time interval having a length identical to that of the first time interval.

The power switching circuit 100 of the present invention performs a switching operation in response to the pulse control signal 120*a* synchronized with the first reference signal 200*a*, and generates the voltage V_EL of the output power. The pulse control signal 120*a*, which is a reference based on which the power switching circuit 100 of the switching converter 130 is operated, may have a period corresponding to 1/M (M is an arbitrary natural number) of the first time interval during which the first row 320 is driven or the second time interval during which the second row 330 is driven. That is, the switching converter 130 performs a switching operation in synchronization with each of the first and second time intervals, and the switching operation of the switching converter 130 forms and completes at least one period during the first time interval during which the first row 320 is driven. In the same manner, the switching operation of the switching converter 130 forms and completes at least one period during the second time interval during which the second row 330 is driven.

That is, in an embodiment in which the pixels 310 constituting the load 300 are driven on a per row basis, the switching operation of the switching converter 130 is completed during a unit time interval during which each row is driven, and the voltage V_EL of the output power transferred to the row from the switching converter 130 during the unit time interval may maintain a target voltage. Accordingly, a power voltage supplied when each row is driven may be regulated to a constant value, and a uniform power voltage may be supplied regardless of the location of the row. Furthermore, each row may be supplied with a uniform power voltage regardless of changes in time because a previously supplied power voltage and a power voltage being currently supplied may be maintained at substantially the same level.

Figure 6:
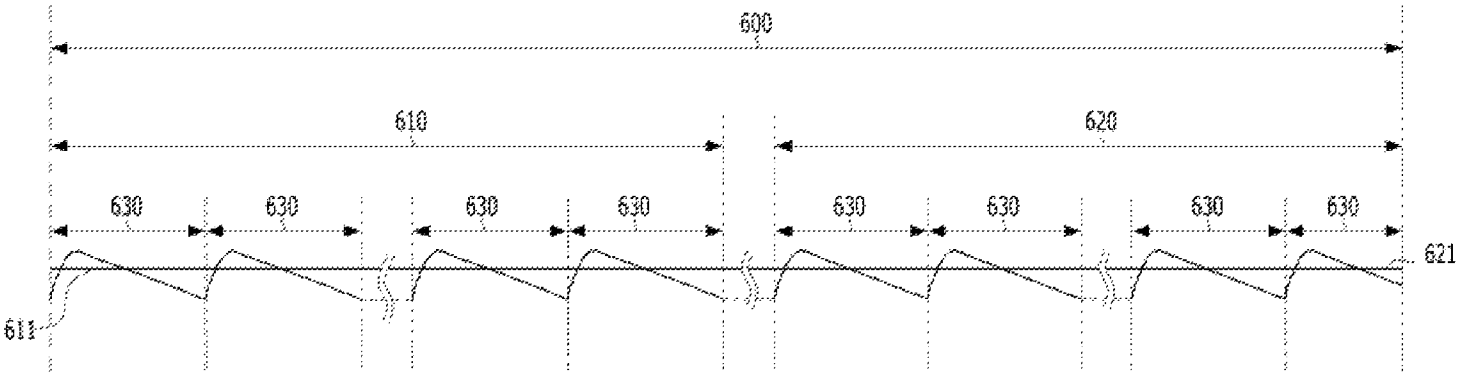
FIG. 6 is a diagram showing an example of the operating waveform of the voltage of the output power of the power switching circuit related to the embodiment of FIG. 5.

FIG. 6 is a diagram showing an example of the operating waveform of the voltage V_EL of the output power of the power switching circuit related to the embodiment of FIG. 5.

Referring to FIG. 6, there are shown a first time frame 600 indicative of a period during which all of the pixels 310 constituting the load 300 scan brightness value data and emit light, a first time interval 610 indicative of a period in which the first row 320 scans brightness value data once and emits light, and a second time interval 620 indicative of a period in which the second row 330 scans brightness value data once and emits light.

The switching converter 130 of the power switching circuit 100 is driven by the generated pulse control signal 120*a* based on the first reference signal 200*a* having a first frequency f1 generated by the timing controller 200. In this case, it is assumed that the pulse control signal 120*a* is generated by PWM. In the case of PWM, the period 630 of the pulse control signal 120*a* may be kept constant. The switching converter 130 may perform a single cycle of switching operation for each period 630 of the pulse control signal 120*a*. The voltage V_EL of the output power periodically repeats rising and falling according to the cycle of switching operation of the switch converter 130. As described above, the waveform shown in FIG. 6 corresponds to the voltage V_EL of the output power that is subjected to the switching operation over the period 630 of the pulse control signal 120*a*. In this case, the voltage V_EL of effective output power with which the load 300, i.e., the first row 320, is supplied during the first time interval 610 may be represented by a first average value 611.

Furthermore, the second time interval 620 is completely synchronized with the period 630 of the pulse control signal, and thus the cycle of switching operation of the power switching circuit 100 may be completed during the second time interval 620. In this case, the voltage V_EL of effective output power with which the load 300, i.e., the second row 330, is supplied during the second time interval 620 may be represented by the second average value 621.

As described above, since the voltage V_EL of the effective output power transferred to the first row 320 during the first time interval 610 and the voltage V_EL of the effective output power transferred to the second row 330 during the second time interval 620 are maintained at the first average value 611 and the second average value 621, respectively, which are the same, the brightness of the first row 320 that emits light during the first time interval 610 and the brightness of the second row 330 that emits light during the second time interval 620 may be maintained at the same level.

As described above, the switching converter 130 of the power switching circuit 100 provides the voltage V_EL of the output power, synchronized with the first control signal 200*a* generated by the timing controller 200, to the load 300, thereby providing uniform brightness throughout the overall screen. Accordingly, according to the embodiment of the present invention, noise or flickering that is observed during display due to non-uniform brightness over the pixels in the conventional technology may be eliminated Although the case of PWM has been assumed and described in FIG. 6, the technical spirit of the present invention is not limited to that embodiment. If the case of PFM is assumed as another embodiment of the present invention, the period of the pulse control signal 120*a* may have a slightly varying value for each pulse unlike that of FIG. 6. In this embodiment, a plurality of pulse control signals 120*a* may be synchronized with the start and end of the first time interval 610. That is, the total length of the time intervals of the plurality of pulse control signals 120*a* is equal to the length of the first time interval 610, and any one pulse control signal 120*a* starts to be synchronized at the start point of the first time interval 610 and another pulse control signal 120*a* is synchronized and terminated at the end point of the first time interval 610.

In the embodiment of PFM, in the case of the second time interval 620, the total length of the time intervals of a plurality of pulse control signals 120*a* is equal to the length of the second time interval 620, and individual pulse control signals 120*a* may be synchronized with the start and end of the second time interval 620. In this case, in the embodiment of PFM, the number of pulse control signals 120*a* corresponding to the first time interval 610 and the number of pulse control signals 120*a* corresponding to the second time interval 620 do not necessarily need to be equal to each other.

Figure 7:
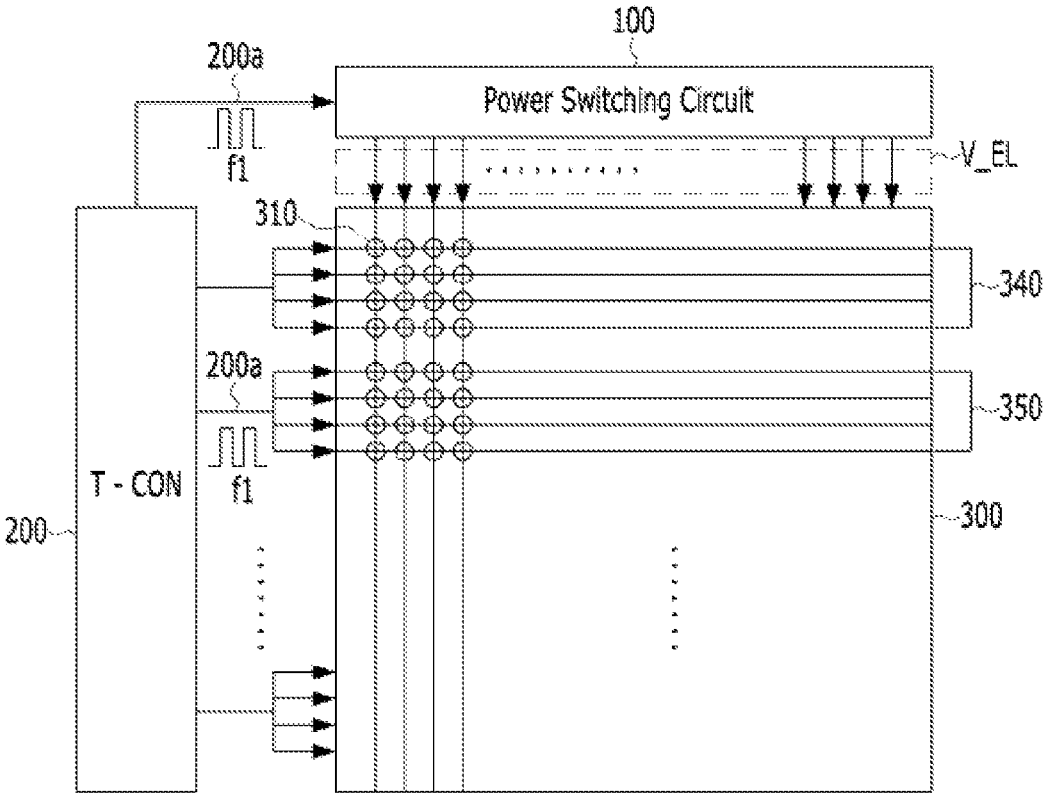
FIG. 7 is a block diagram conceptually showing a power switching circuit for driving a load according to another embodiment of the present invention.

FIG. 7 is a block diagram conceptually showing a power switching circuit for driving a load according to another embodiment of the present invention.

Referring to FIG. 7, a first region 340 including four rows and a second region 350 including different four rows are shown. In FIG. 7, pixels 310 scan data and emit light on a per region, including a plurality of rows, basis.

The process in which the pixels 310 included in the first region 340 scan data and emit light may be performed during the first time interval 610. In the same manner, the process in which the pixels 310 included in the second region 350 scan data and emit light may be performed during the second time interval 620.

As described above, in an embodiment of the present invention, the pixels 310 included in the load 300 and arranged in the form of an array may be driven on a per row or region (or block) basis, and the power switching circuit 100 may determine the minimum period of the pulse control signal 120*a* by taking into account a minimum time interval during which the pixels 310 are driven (scan data and emit light).

The minimum period of the pulse control signal 120*a* may be determined based on the time frame during which all the pixels 310 are driven and a minimum unit or time interval during which the pixels 310 are partially driven. In order to implement the minimum period of the pulse control signal 120*a*, the frequency control circuit 110 may generate the second reference signal 110*a* by dividing or changing the period of the first reference signal 200*a* that is received from the timing controller 200.

Although the embodiments of the load 300 in which the pixels 310 are driven on a per row basis have been shown in FIGS. 5 and 7, anther embodiment of the present invention in which pixels 310 are driven on a per column basis may be implemented.

Figure 8:
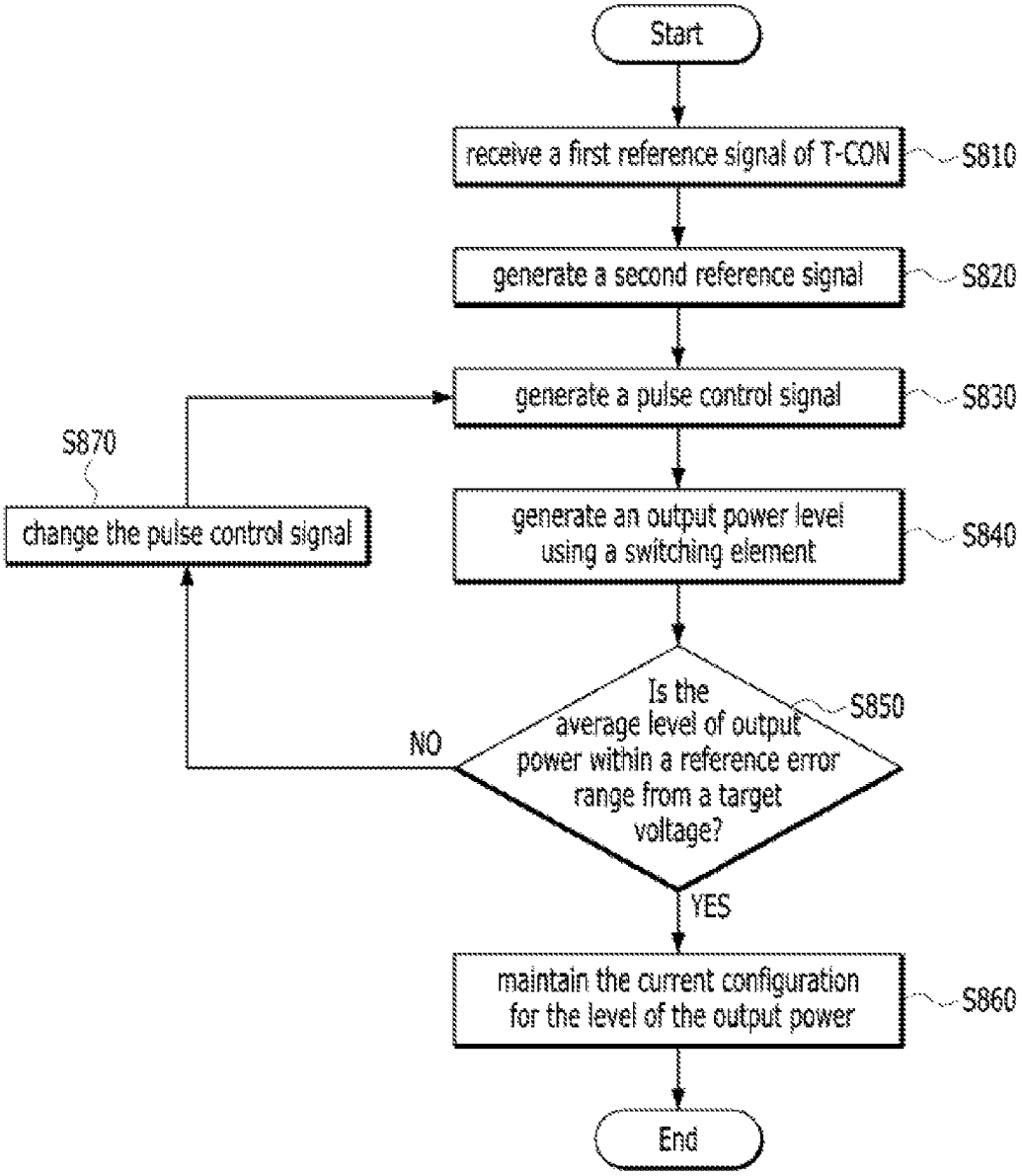
FIG. 8 is an operation flowchart showing a method for controlling a power switching circuit according to an embodiment of the present invention.

FIG. 8 is an operation flowchart showing a method for controlling a power switching circuit according to an embodiment of the present invention. The control method of FIG. 8 is based on the power switching circuit 100 of FIG. 3.

Referring to FIG. 8, the frequency control circuit 110 of the power switching circuit 100 receives a first reference signal 200*a*, adapted to drive the load 300, from the timing controller 200 at step S810.

The frequency control circuit 110 of the power switching circuit 100 generates a second reference signal 110*a* based on the received first reference signal 200*a* at step S820. The second reference signal 110*a* may be a signal that is generated by time dividing the first reference signal 200*a* or by buffering the first reference signal 200*a* in order to drive a DC-DC converter, such as the switching converter 130.

The pulse modulation circuit 120 generates a pulse control signal 120*a* by performing PWM or PFM on the second reference signal 110*a* at step S830.

The switching converter 130 generates the voltage V_EL level of output power by performing switching operation in response to the pulse control signal 120*a* at step S840.

In this case, the feedback circuit 140 generates a feedback signal in response to the voltage V_EL level of the output power, and transfers the feedback signal to the pulse modulation circuit 120.

In this case, if the average level of the voltage V_EL of the output power is maintained within a reference error range from a target voltage at step S850, the pulse modulation circuit 120 may maintain the voltage V_EL level of the output power while maintaining the duty cycle of the pulse control signal 120*a* without change at step S860. If the average level of the voltage V_EL of the output power is out of the reference error range from the target voltage at step S 850, the pulse modulation circuit 120 may change the voltage V_EL level of the output power by changing the duty cycle of the pulse control signal 120*a* at step S870.

The target voltage is a target voltage that the average level of the voltage V_EL of the output power needs to reach, and a reference voltage Vref may be determined based on the target voltage. The reference voltage Vref may be designed by taking into account the configuration of the feedback circuit 140, a feedback network and the target voltage.

According to at least one embodiment of the present invention, the brightness of pixels constituting the screen of a display device can be maintained at a uniform level regardless of the locations and light emission periods of pixels. A uniform brightness value can be acquired by supplying a uniform power voltage to pixels regardless of the locations and light emission time intervals of the pixels using the embodiment of the present invention.

According to at least one embodiment of the present invention, pixels, constituting the screen of a display device, are divided into rows, columns, blocks, or sub-regions and then a uniform power voltage is provided to the pixels of different rows, columns, blocks, or sub-regions, thereby maintaining uniform brightness.

According to at least one embodiment of the present invention, uniform brightness can be maintained throughout a display screen, thereby achieving the advantage of reducing the fatigue of the eyes of a user who is viewing the screen. According to at least one embodiment of the present invention, an advantage can be achieved in that even when a screen is a large-sized screen, there is no need to require an additional circuit configuration in order to maintain the uniform brightness of the sectional regions of a display screen.

At least one embodiment of the present invention can not only maintain the uniform brightness of pixels constituting the screen of a display device, but can also maintain the uniform brightness of channels when it is applied to a multichannel LED.

According to at least one embodiment of the present invention, the period or average period of a pulse control signal adapted to drive a power switching circuit is synchronized with a periodic timing signal T-CON adapted to drive a load, and thus a uniform effective power voltage can be supplied to the sectional regions of the load.

However, the advantages of the present invention are not limited to the above-described advantages, but may be extended in various manners without departing from the technical spirit and scope of the present invention.

While the present invention has been described in conjunction with specific details, such as specific elements, and limited embodiments and diagrams above, these are provided merely to help an overall understanding of the present invention. The present invention is not limited to these embodiments, and various modifications and variations can be made based on the foregoing description by those having ordinary knowledge in the art to which the present invention pertains.

Therefore, the technical spirit of the present invention should not be determined based only on the described embodiments, and the following claims, all equivalents to the claims and equivalent modifications should be construed as falling within the scope of the spirit of the present invention.

What is claimed is:

1. A power switching circuit, comprising:

a frequency control circuit configured to:

receive a first reference signal starting operation of driving a load, from a timing controller, wherein the first reference signal is related to the timing information of the operation of the driving load; and generate a second reference signal based on the first reference signal;

a pulse modulation circuit configured to generate a pulse control signal by performing pulse width modulation (PWM) or pulse frequency modulation (PFM) on the second reference signal; and a switching convertor configured to generate a voltage of output power by switching a switching element connected to the output power, in response to the pulse control signal;

wherein the pulse control signal is synchronized with the first reference signal starting the operation of driving the load.

2. The apparatus of claim 1, wherein the pulse control signal is synchronized with each of a first time interval being a part of a first time frame corresponding to a period during which the load is driven, and a second time interval being another part of the first time frame.

3. The apparatus of claim 2, wherein:

the load is a semiconductor device that drives each of pixels included in a screen; and the first time frame is a reference time period during which all the pixels on the screen are displayed at least once.

4. The apparatus of claim 2, wherein:

a first region, including a part of the pixels on the screen, is displayed during the first time interval; and a second region, including another part of the pixels on the screen, is displayed during the second time interval.

5. The apparatus of claim 2, wherein the pulse modulation circuit generates a pulse modulation signal so that each of a first average voltage of the output power in the first time interval and a second average voltage of the output power in the second time interval is maintained within a reference error range from a target voltage.

6. The apparatus of claim 1, further comprising a feedback circuit configured to:

generate a feedback signal in response to the voltage of the output power; and transfer the feedback signal to the pulse modulation circuit.

7. The apparatus of claim 1, wherein the pulse modulation circuit synchronizes start and end points of a pulse control signal group, including a series of pulse control signals, with start and end points of the first reference signal.

8. A method for controlling a power switching circuit, comprising:

receiving a first reference signal starting operation of driving a load, from a timing controller, wherein the first reference signal is related to the timing information of the operation of driving the load;

generating a second reference signal based on the first reference signal;

generating a pulse control signal by performing PWM or PFM on the second reference signal; and generating an output power level by switching between input power and output power in response to the pulse control signal;

wherein the pulse control signal is synchronized with the first reference signal starting the operation of driving the load.

9. The method of claim 8, wherein the pulse control signal is synchronized with each of a first time interval being a part of a first time frame corresponding to a period during which the load is driven, and a second time interval being another part of the first time frame.

10. The method of claim 9, wherein:

the load is a semiconductor device that drives each of pixels included in a screen; and the first time frame is a reference time period during which all the pixels on the screen are displayed at least once.

11. The method of claim 8, further comprising generating a feedback signal in response to the voltage of the output power and transferring the feedback signal to the pulse modulation circuit.

12. The method of claim 8, wherein the generating a pulse control signal comprises synchronizing start and end points of a pulse control signal group including a series of pulse control signals, with start and end points of the first reference signal.

* * * * *